US009702203B2

(12) United States Patent
Bolstad, Jr.

(10) Patent No.: US 9,702,203 B2
(45) Date of Patent: Jul. 11, 2017

(54) POLISHED ROD ALIGNMENT SYSTEM

(71) Applicant: Clarence Alvin Bolstad, Jr., Culbertson, MT (US)

(72) Inventor: Clarence Alvin Bolstad, Jr., Culbertson, MT (US)

( * ) Notice: Subject to any disclaimer, the term of this patent is extended or adjusted under 35 U.S.C. 154(b) by 311 days.

(21) Appl. No.: 14/601,534

(22) Filed: Jan. 21, 2015

(65) Prior Publication Data

US 2016/0208565 A1 Jul. 21, 2016

(51) Int. Cl.

| | |
|---|---|
| ***E21B 33/03*** | (2006.01) |
| ***E21B 17/10*** | (2006.01) |
| ***E21B 33/038*** | (2006.01) |
| ***E21B 19/00*** | (2006.01) |
| ***E21B 19/24*** | (2006.01) |
| ***E21B 33/06*** | (2006.01) |
| ***E21B 33/08*** | (2006.01) |

(52) U.S. Cl.

CPC ..... *E21B 17/1071* (2013.01); *E21B 19/00* (2013.01); *E21B 19/24* (2013.01); *E21B 33/038* (2013.01); *E21B 33/06* (2013.01); *E21B 33/08* (2013.01)

(58) Field of Classification Search

CPC ..... E21B 17/1071; E21B 33/08; E21B 19/00; E21B 33/06; E21B 33/038; E21B 19/24

See application file for complete search history.

(56) References Cited

U.S. PATENT DOCUMENTS

| | | | | |
|---|---|---|---|---|
| 1,917,742 | A | 7/1933 | Tinsley | |
| 2,628,112 | A | 2/1953 | Hebard | |
| 3,477,748 | A | 11/1969 | Tinsley | |
| 4,099,562 | A | 7/1978 | Mattoon | |
| 4,579,350 | A | 4/1986 | Knox | |
| 4,889,184 | A | 12/1989 | Lugtmeier | |
| 5,427,178 | A * | 6/1995 | Bland | E21B 33/0415 166/78.1 |
| 5,711,533 | A | 1/1998 | Angelo | |
| 6,412,783 | B1 | 7/2002 | Finnestad | |
| 6,637,509 | B2 | 10/2003 | Farquharson | |
| 2005/0103505 | A1 * | 5/2005 | Lappin | E21B 33/08 166/387 |
| 2013/0126157 | A1 | 5/2013 | Farrar | |

* cited by examiner

*Primary Examiner* — Yong-Suk (Philip) Ro

(74) *Attorney, Agent, or Firm* — Neustel Law Offices

(57) ABSTRACT

A polished rod alignment system for correcting the misalignment of a polished rod to the stuffing box which generally includes a first member, a second member, a first alignment member, and a second alignment member. The second member is secured over an oil well, such as to a blowout preventer. The first and second alignment members are secured over the second member, with the alignment members being adapted to rock with respect to each other due to each having inverted sloped portions. The first member is secured over the alignment members and is adapted to receive a stuffing box. A polished rod may extend through the first and second members. By adjusting bolts securing the first and second members together, and by action of the alignment members, the polished rod and stuffing box may be brought back into alignment if misalignment occurs.

17 Claims, 16 Drawing Sheets

POLISHED ROD ALIGNMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to an alignment system and more specifically it relates to a polished rod alignment system for correcting the misalignment of a polished rod to the stuffing box, such as on a pumping oil well.

Description of the Related Art

Any discussion of the related art throughout the specification should in no way be considered as an admission that such related art is widely known or forms part of common general knowledge in the field.

Polished rods are often utilized in combination with stuffing boxes in pumping operations, such as at an oil well. The polished rod will generally slide up and down through the stuffing box and into the oil well, such as through a blowout preventer. Due to the vibrations typical at pumping sites (such as from the oil well itself or from heavy machinery passing nearby), as well as settling, frost heaving and thaw cycles typical at pumping sites, the polished rod will often lose alignment with the stuffing box.

In such situations, it is often an arduous and inefficient task to correct the alignment. Often the pump will need to be shut down entirely so as to allow for the alignment of the polished rod to be adjusted. Such a shutdown can lead to lost pumping time, the requirement to add a crane, and labor costs related to leveling and aligning the pumping unit to the well bore (such as aligning the polish rod to the stuffing box), and thus loss of efficiency of the pumping operation overall.

Because of the inherent problems with the related art, there is a need for a new and improved polished rod alignment system for correcting the misalignment of a polished rod to the stuffing box, such as on a pumping oil well.

BRIEF SUMMARY OF THE INVENTION

The invention generally relates to an alignment system which includes a first member, a second member, a first alignment member, and a second alignment member. The second member is secured over an oil well, such as to a blowout preventer. The first and second alignment members are secured over the second member, with the alignment members being adapted to rock with respect to each other due to each having inverted sloped portions. The first member is secured over the alignment members and is adapted to receive a stuffing box. A polished rod may extend through the entirety of the present invention. By adjusting bolts securing the first and second members together, and by action of the alignment members, the polished rod and stuffing box may be brought back into alignment if misalignment occurs.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
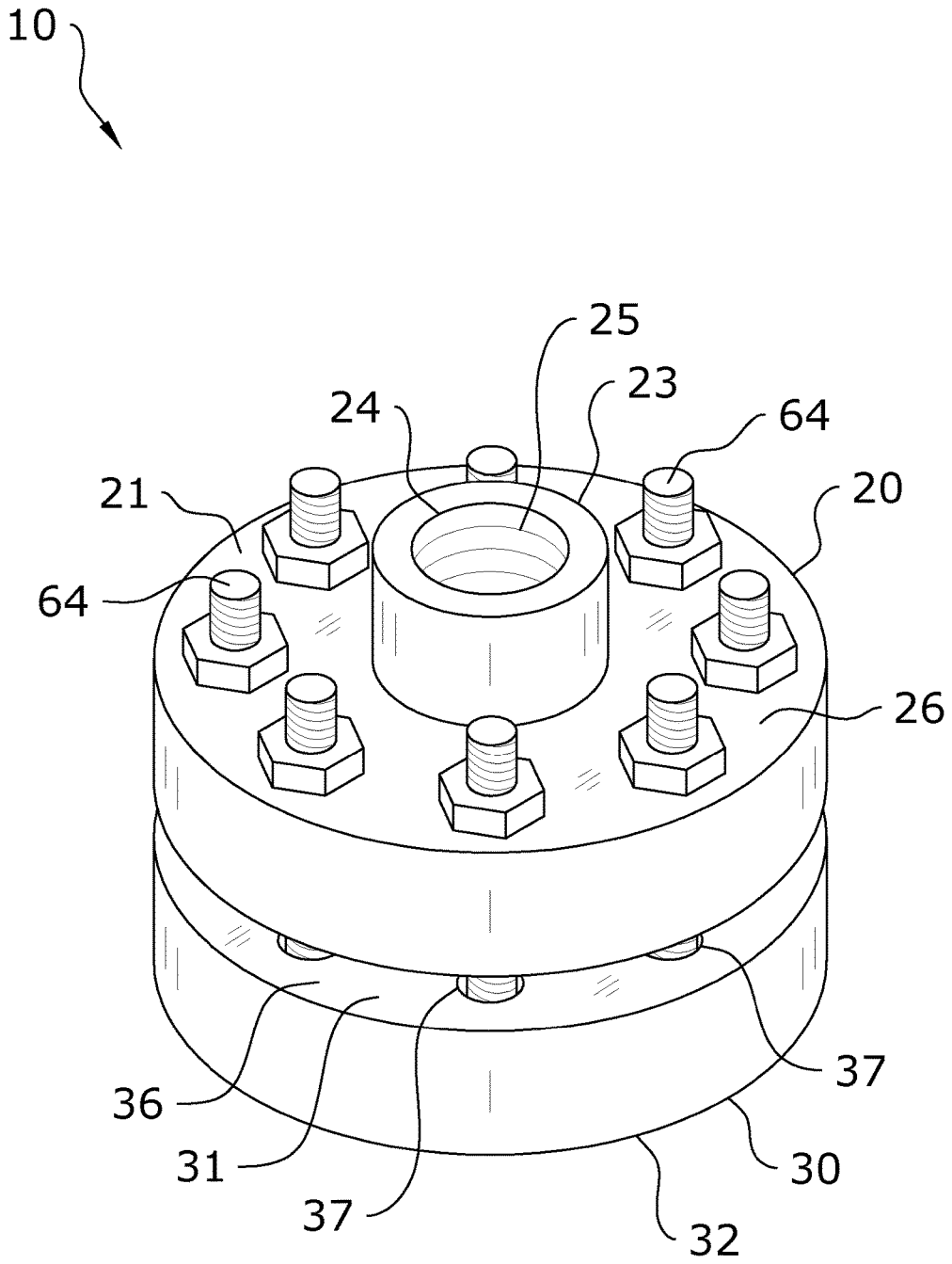
FIG. 1 is an upper perspective view of a first embodiment of the present invention.

A. Overview.

Turning now descriptively to the drawings, in which similar reference characters denote similar elements throughout the several views, FIGS. 1 through 16 illustrate a polished rod alignment system 10, which comprises a first member 20, a second member 30, a first alignment member 40, and a second alignment member 50. The second member 30 is secured over an oil well, such as to a blowout preventer 14. The first and second alignment members 40, 50 are secured over the second member 30, with the alignment members 40, 50 being adapted to rock with respect to each other due to each having inverted sloped portions 46, 56. The first member 20 is secured over the alignment members 40, 50 and is adapted to receive a stuffing box 13. A polished rod 12 may extend through the entirety of the present invention. By adjusting bolts 64 securing the first and second members 20, 30 together, and by action of the alignment members 40, 50, the polished rod 12 and stuffing box 13 may be brought back into alignment if misalignment occurs.

B. First and Second Members.

As shown throughout the figures, the present invention includes a first member 20 and a second member 30 which are secured around the alignment members 30, 40. The polished rod 12 will generally extend through both the first and second members 20, 30 prior to exiting the present invention, such as into a blowout preventer 14 as shown in the figures. The figures illustrate the first member 20 as comprising an upper member and the second member comprising a lower member 30, though other configurations could be utilized.

The shape, size, configuration, and orientation may vary in different embodiments. The figures illustrate the first and second members 20, 30 as being comprised of disc-shaped configurations, though others may be utilized. It is not necessary that the first and second members 20, 30 be round as shown for performing the functionality of the present invention. Further, the size of the first and second members 20, 30 may vary depending on the embodiment of the present invention. Finally, with respect to the orientation, the first and second members 20, 30 could be oriented horizontally or diagonally and thus not have an upper-lower relationship as shown in the figures.

Figure 2:
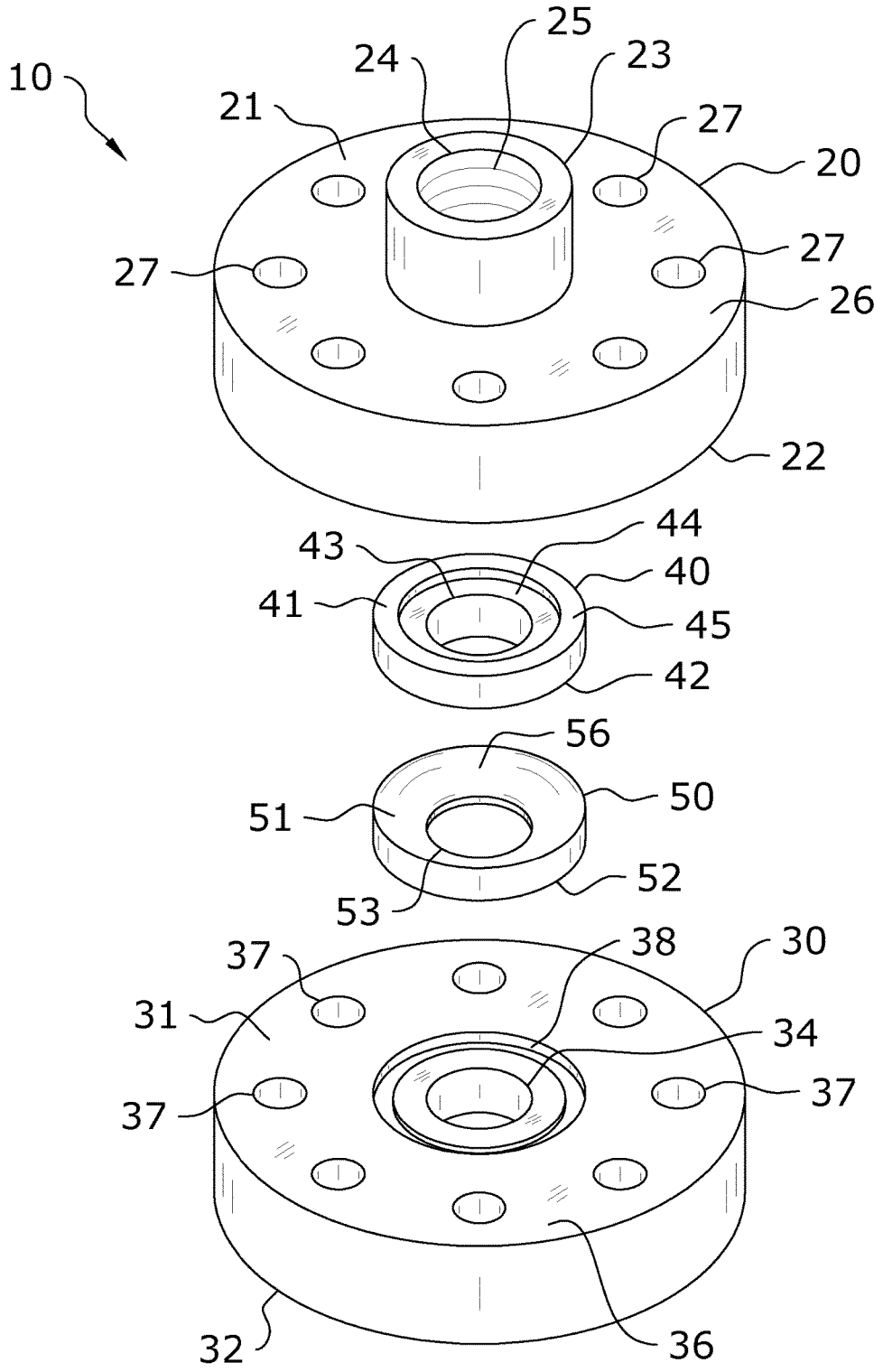
FIG. 2 is an upper perspective exploded view of the first embodiment of the present invention.
Figure 3:
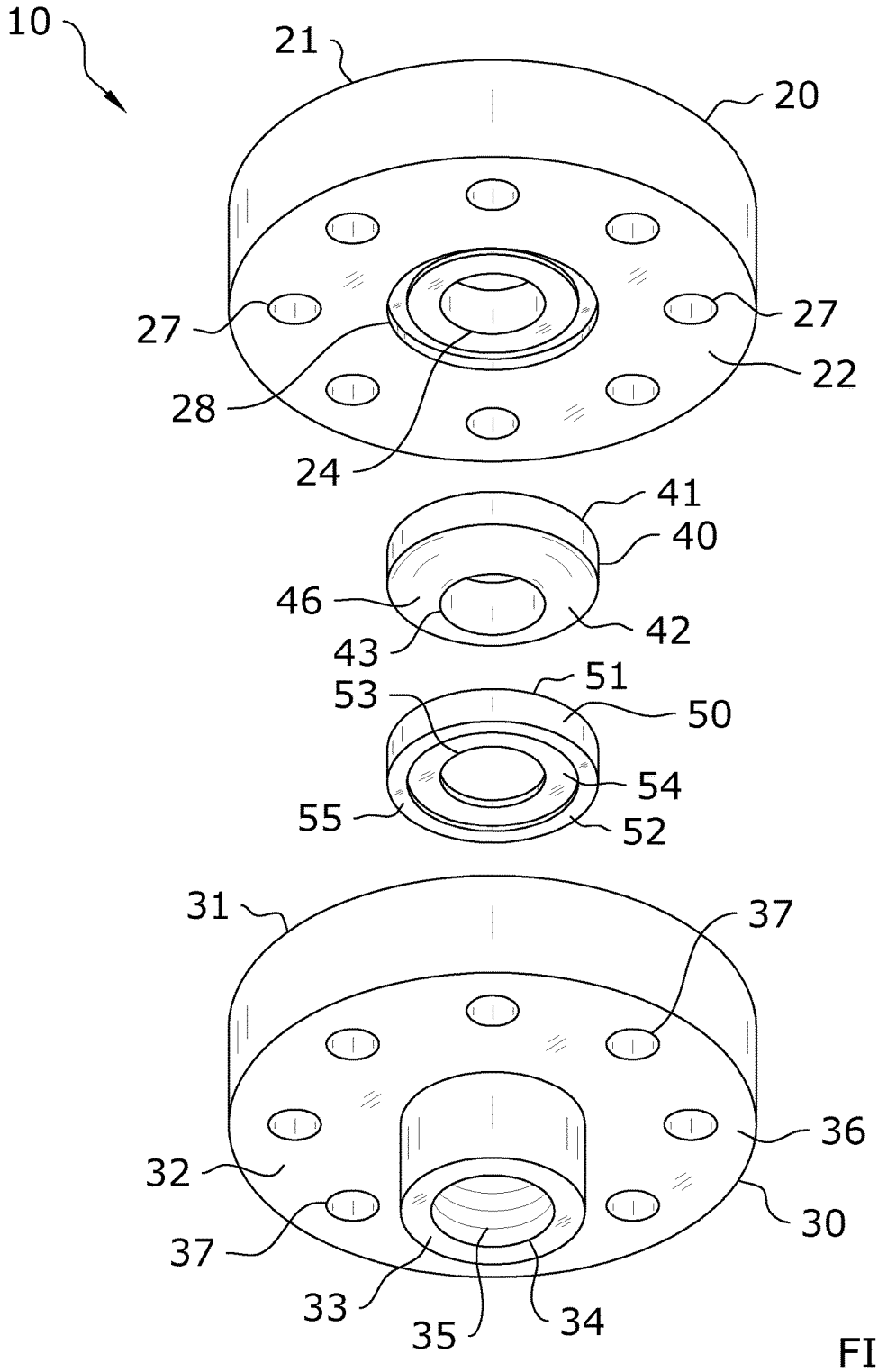
FIG. 3 is a lower perspective exploded view of the first embodiment of the present invention.
Figure 4:
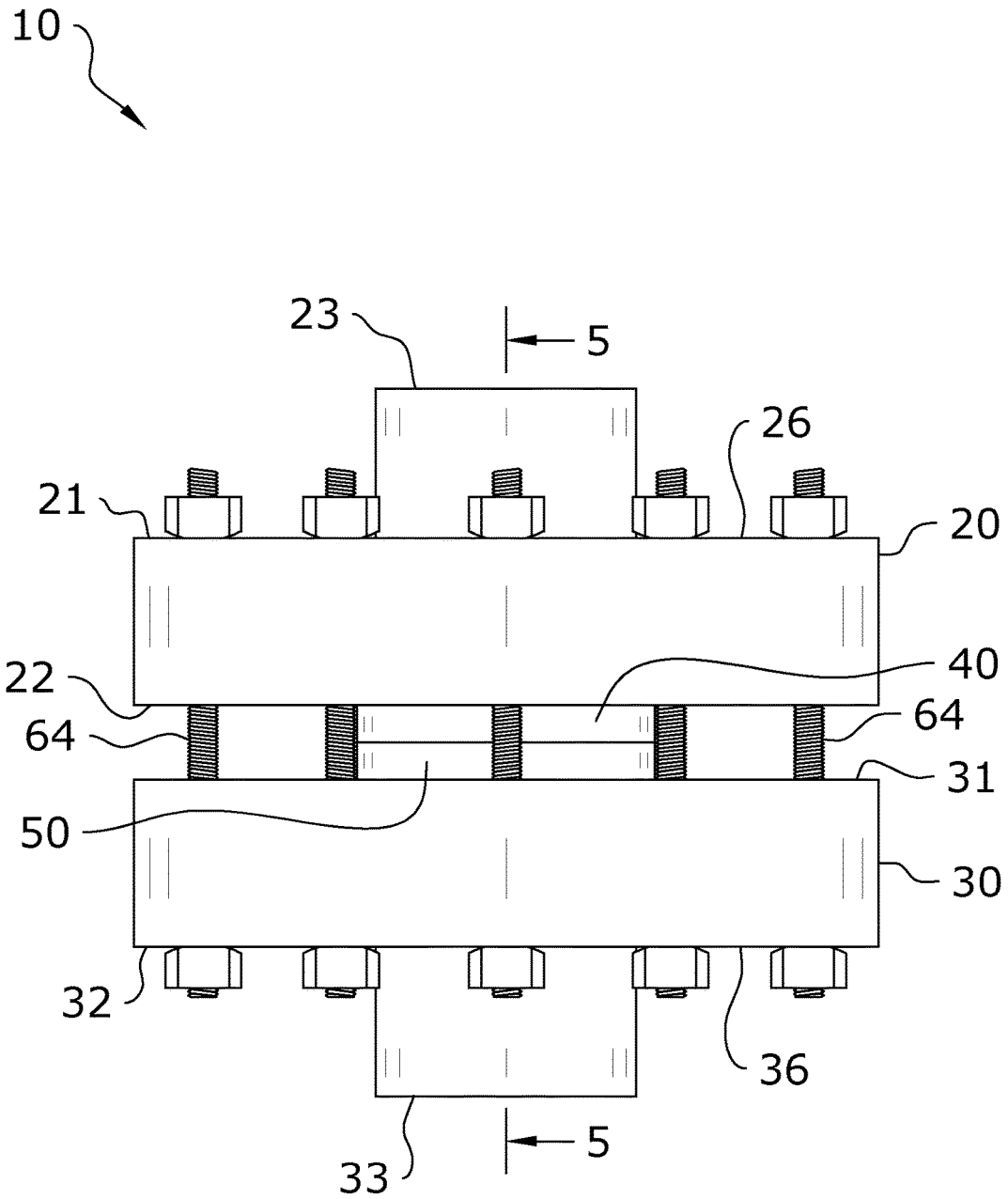
FIG. 4 is a frontal view of the first embodiment of the present invention.

The first member 20 is best shown in FIGS. 2 and 3. As shown therein, the first member 20 generally comprises an upper end 21 and a lower end 22. A first receiver opening 24 extends through the first member 20 between the upper and lower ends 21, 22 so that a polished rod 12 may extend completely through the first member 20. The length, width (or circumference), and cross-section of the first receiver opening 24 may vary in different embodiments, though it should be sufficiently configured to allow the polished rod 12 to freely pass therethrough.

Figure 5:
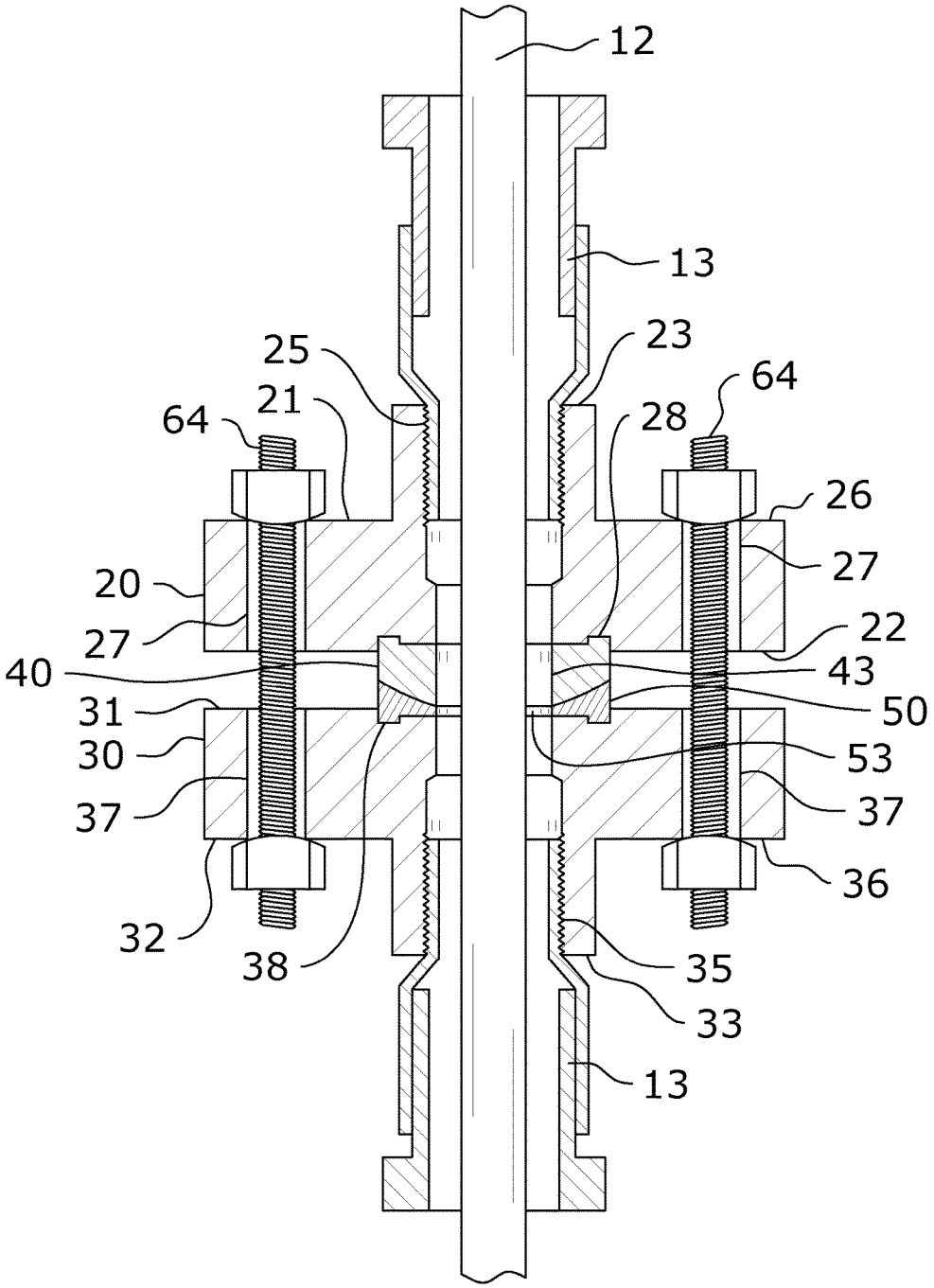
FIG. 5 is a sectional view of the first embodiment of the present invention in use.
Figure 6:
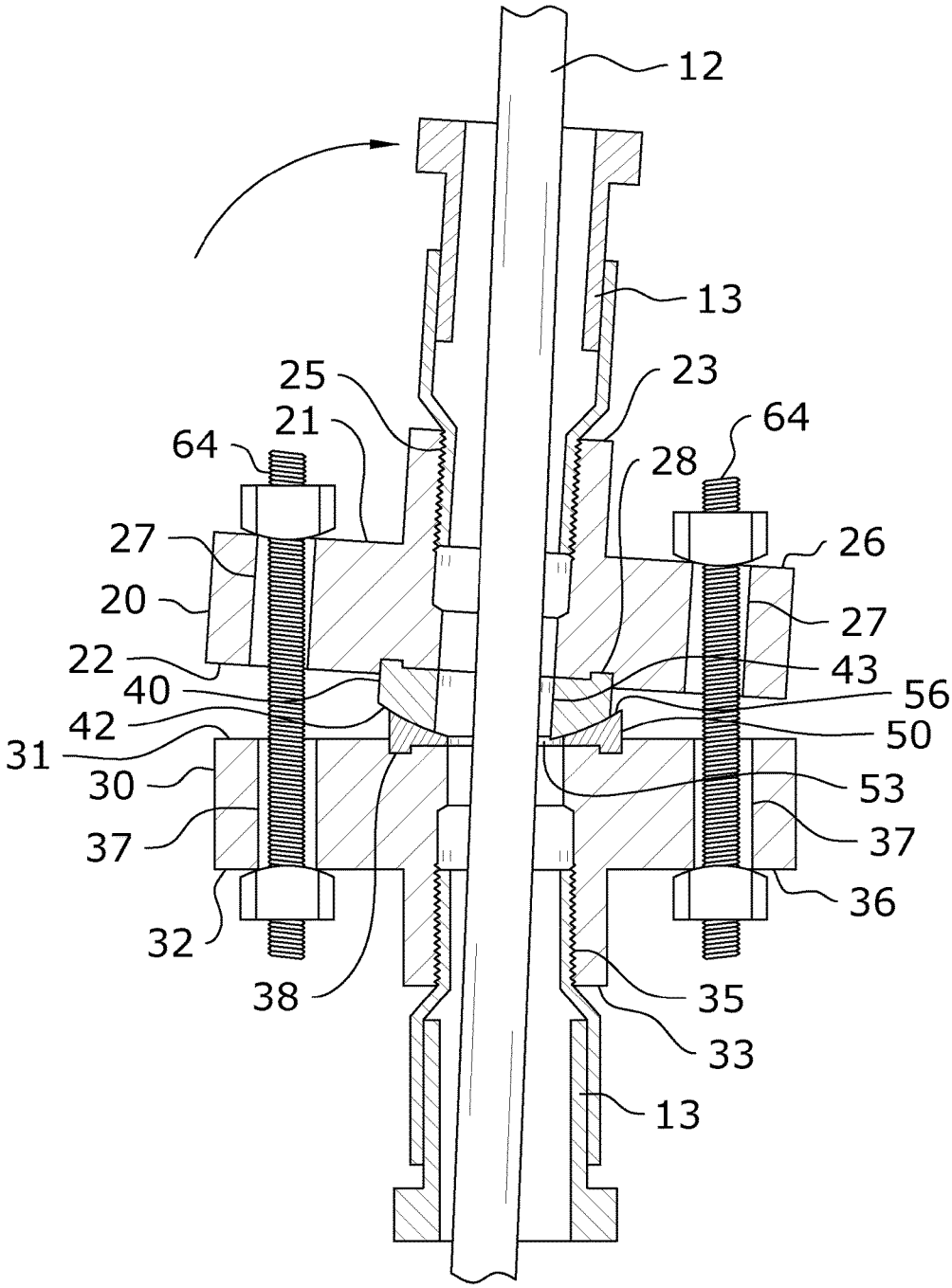
FIG. 6 is a sectional view of the first embodiment of the present invention adjusted for misalignment of the polished rod to the right.
Figure 7:
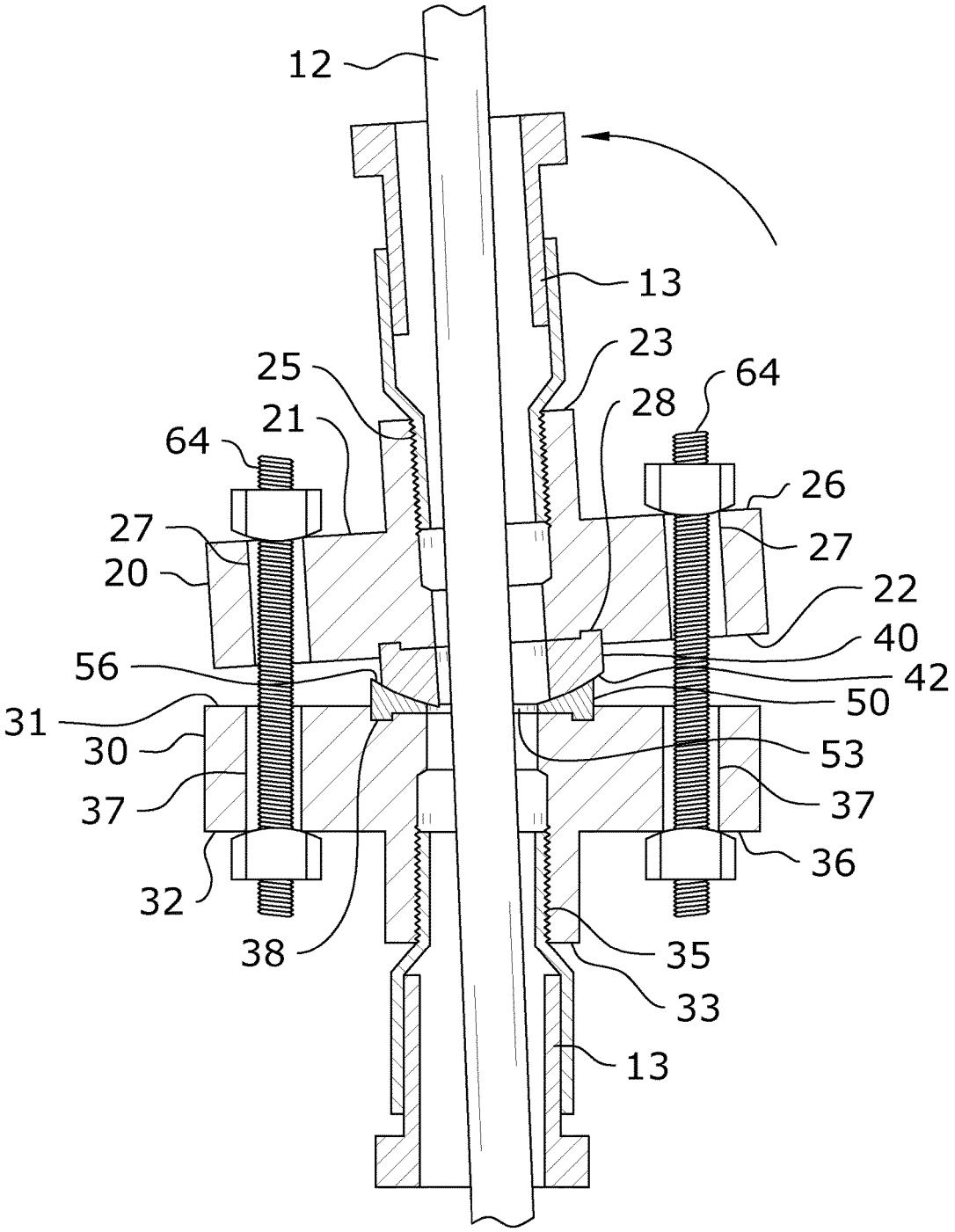
FIG. 7 is a sectional view of the first embodiment of the present invention adjusted for misalignment of the polished rod to the left.
Figure 8:
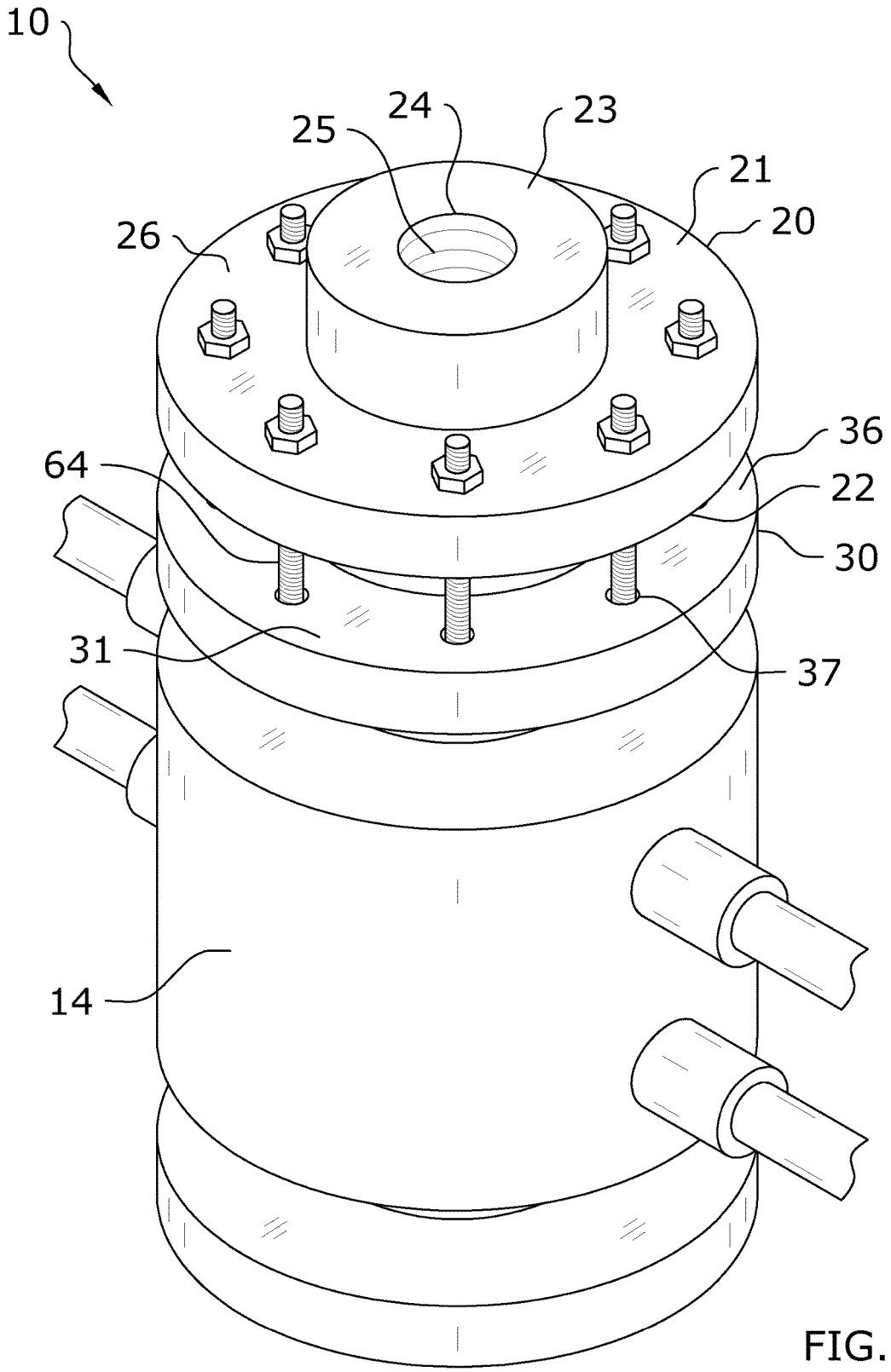
FIG. 8 is an upper perspective view of the present invention installed on a blowout preventer.

As best shown in FIG. 2, the first member 20 includes a first receiver rim 23 which extends outwardly from its upper end 21. The first receiver opening 24 extends through the first receiver rim 23 and the body of the first member 20. The first receiver rim 23 comprises a raised rim which surrounds the outer circumference of the first receiver opening 24. The first receiver rim 23 provides a guide to the polished rod 12 as it enters the first member 20 through the first receiver opening 24. The inner surface of the first receiver rim 23 may include first inner threads 25 as shown in FIG. 2 to aid in attachment of a stuffing box 13 as shown in FIG. 5.

As best shown in FIG. 2, a first flange 26 extends from the first receiver rim 23. The first flange 26 extends outwardly from the first receiver rim 23 and includes a plurality of first apertures 27 along its outer circumference as shown in FIG. 2. The shape, size, orientation, and configuration of the first flange 26 may vary in different embodiments of the present invention. Further, the number of first apertures 27, and their orientation along the first flange 26, may vary and should not be construed as limited by the figures.

As shown in FIG. 3, the first member 20 may also include a first receiver groove 28 in some embodiments. The first receiver groove 28 will generally be positioned on the lower end 22 of the first member 20 so as to receive the first rim 45 of the first alignment member 40, which aids in securing the first member 20 to the first alignment member 40. The first receiver groove 28 will generally extend around the first receiver opening 24 on the lower end 22 of the first member 20 as shown in FIG. 3. However, in alternate embodiments the first receiver groove 28 may be positioned elsewhere, or may be comprised of a different shape than the circular configuration shown in the exemplary figures.

The second member 30 is best shown in FIGS. 2 and 3. As shown therein, the second member 31 generally comprises an upper end 31 and a lower end 32. A second receiver opening 34 extends through the second member 30 between the upper and lower ends 31, 32 so that a polished rod 12 may extend completely through the second member 30. The length, width (or circumference), and cross-section of the second receiver opening 34 may vary in different embodiments, though it should be sufficiently configured to allow the polished rod 12 to freely pass therethrough.

As best shown in FIG. 3, the second member 30 includes a second receiver rim 33 which extends outwardly from its lower end 32. The second receiver opening 34 extends through the second receiver rim 33 and the body of the second member 30. The second receiver rim 33 comprises a raised rim which surrounds the outer circumference of the second receiver opening 24. The second receiver rim 33 provides a guide to the polished rod 12 as it exits the second member 30 through the second receiver opening 34. The inner surface of the second receiver rim 33 may include second inner threads 35 as shown in FIG. 3 to aid in attachment to a blowout preventer 14 as shown in FIG. 5.

As best shown in FIG. 2, a second flange 36 extends from the second receiver rim 33. The second flange 36 extends outwardly from the second receiver rim 33 and includes a plurality of second apertures 37 along its outer circumference as shown in FIG. 2. The shape, size, orientation, and configuration of the second flange 36 may vary in different embodiments of the present invention. Further, the number of second apertures 37, and their orientation along the second flange 36, may vary and should not be construed as limited by the figures. A plurality of bolts 64 are generally utilized to extend through both the first apertures 27 of the first member 20 and the second apertures 37 of the second member 30 to secure the first and second members 20, 30 to each other.

As shown in FIG. 2, the second member 30 may also include a second receiver groove 38 in some embodiments. The second receiver groove 38 will generally be positioned on the upper end 31 of the second member 30 so as to receive the second rim 55 of the second alignment member 50, which aids in securing the second member 30 to the second alignment member 50. The second receiver groove 38 will generally extend around the second receiver opening 34 on the upper end 31 of the second member 30 as shown in FIG. 2. However, in alternate embodiments the second receiver groove 38 may be positioned elsewhere, or may be comprised of a different shape than the circular configuration shown in the exemplary figures.

C. Alignment Members.

As shown throughout the figures, the present invention includes a first alignment member 40 and a second alignment member 50 which combine to form an alignment assembly. The alignment members 40, 50 adjust to accommodate any non-vertical movement of the polished rod 12 as it traverses through the present invention in either direction. While the figures illustrate the alignment members 40, 50 as comprising two discrete structures, it should be appreciated that in some embodiments the alignment members 40, 50 may comprise a single, integral structure.

Generally speaking, the alignment members 40, 50 will be secured between the first and second members 20, 30 as shown throughout the figures. The figures illustrate two embodiments of the present invention; a first embodiment in which no O-rings 60, 61, 62 are utilized which is shown in FIGS. 2, 3, and 5-7 and a second embodiment in which O-rings 60, 61, 62 are utilized which is shown in FIGS. 9 and 12-16.

As shown throughout the figures, the present invention includes a first alignment member 40 which is secured against the lower end 22 of the first member 20. The first alignment member 40 includes an upper end 41 and a lower end 42. While the figures illustrate the first alignment member 40 as comprising a round configuration, other configurations may be utilized. A first opening 43 extends through the first alignment member 40 between its upper and lower ends 41, 42 through which the polished rod 12 will extend when the present invention is in use. The shape, size, and configuration of the first opening 43 may vary in different embodiments.

As best shown in FIG. 2, the upper end 41 of the first alignment member 40 may include a first recessed portion 44 surrounding the first opening 43 and a first rim 45 extending around its outer circumference which rises outwardly from the first recessed portion 44. The first rim 45 fits within the first receiver groove 28 on the lower end 22 of the first member 20 as shown in FIG. 5 to secure the first alignment member 40 underneath the first member 20.

The lower end 42 of the first alignment member 40 generally comprises a sloped configuration and thus includes a first sloped portion 46 as best shown in FIG. 3. The first sloped portion 46 will generally slope outwardly from the first opening 43 to the outer edge of the first alignment member 40 as shown in FIG. 3. The first sloped portion 46 interacts with the second sloped portion 56 of the second alignment member 50 to allow the alignment members 40, 50 to adjust to accommodate vibrations or other movements of the polished rod 12.

Figure 9:
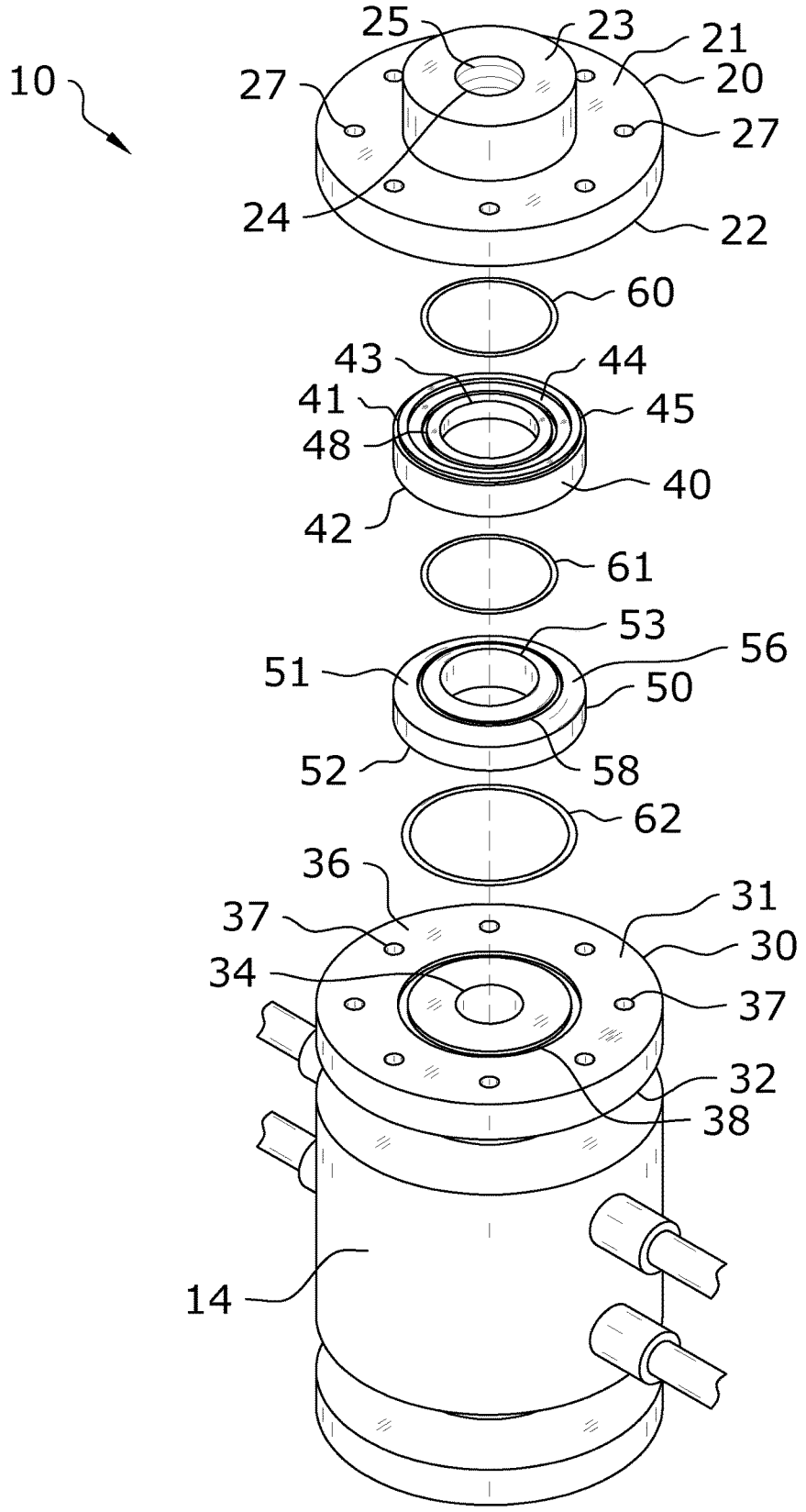
FIG. 9 is an exploded upper perspective view of a second embodiment of the present invention.
Figure 10:
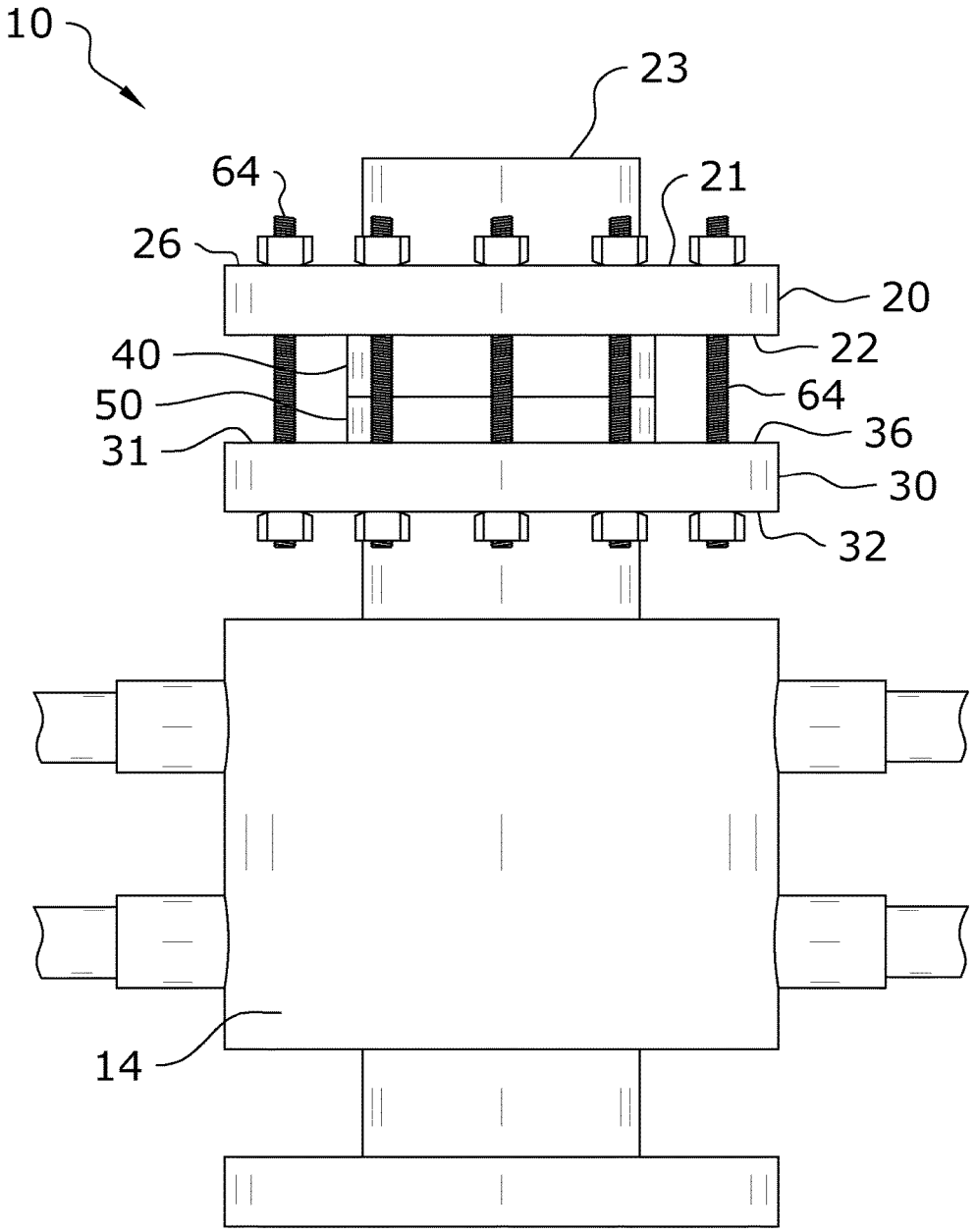
FIG. 10 is a side view of the present invention installed on a blowout preventer.
Figure 11:
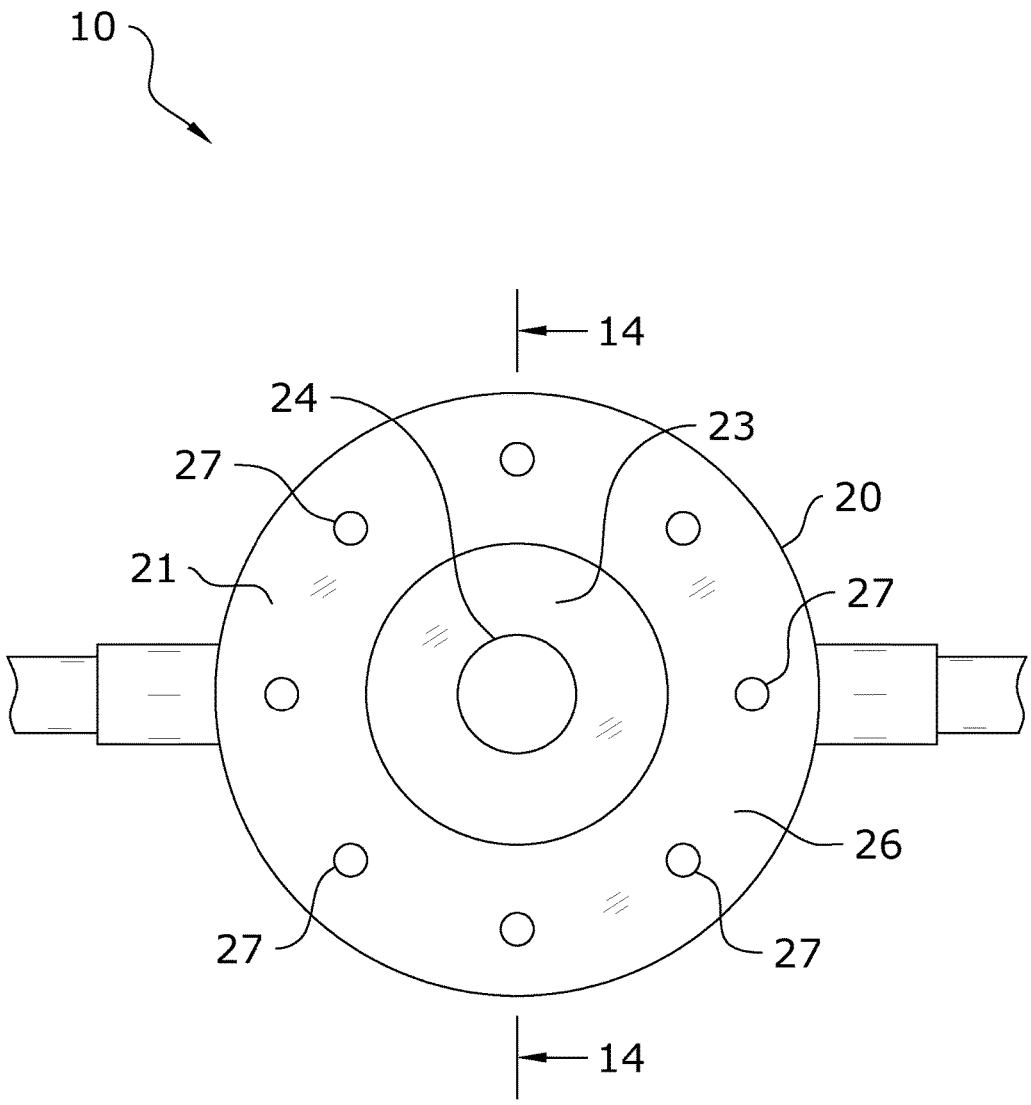
FIG. 11 is a top view of the present invention installed on a blowout preventer.

An alternate embodiment of the first alignment member 40, in which O-rings 60, 61, 62 are utilized to perfect seals between the first member 20, the first alignment member 40, the second alignment member 50, and the second member 30 is shown in FIGS. 9 and 12-16. In such an embodiment, the first alignment member 40 includes a first upper O-ring groove 48 on its upper end 21 as shown in FIG. 9.

Figure 14:
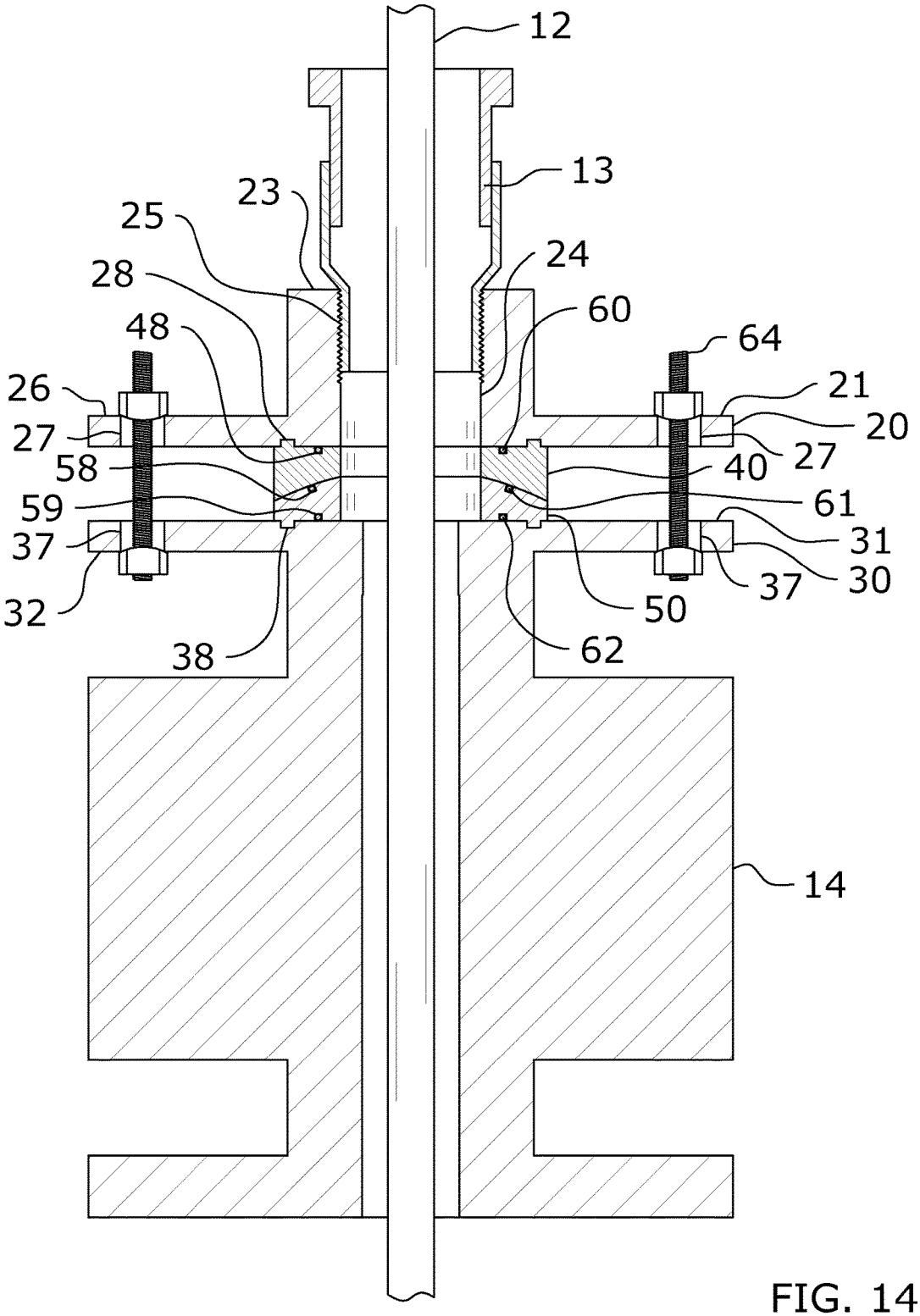
FIG. 14 is a sectional view of the second embodiment of the present invention in use.

The first upper O-ring groove 48 generally extends around the outer circumference of the first opening 43 of the first alignment member 40, though it may be positioned elsewhere in different embodiments. A first O-ring 60 is positioned within the first upper O-ring groove 48 as shown in FIG. 14, which seals the connection between the first alignment member 40 and the first member 20.

As shown throughout the figures, the present invention includes a second alignment member 50 which is secured against the upper end 31 of the second member 30. The second alignment member 50 includes an upper end 51 and a lower end 52. While the figures illustrate the second alignment member 50 as comprising a round configuration, other configurations may be utilized. A second opening 53 extends through the second alignment member 50 between its upper and lower ends 51, 52 through which the polished rod 12 will extend when the present invention is in use. The shape, size, and configuration of the second opening 53 may vary in different embodiments.

Figure 13:
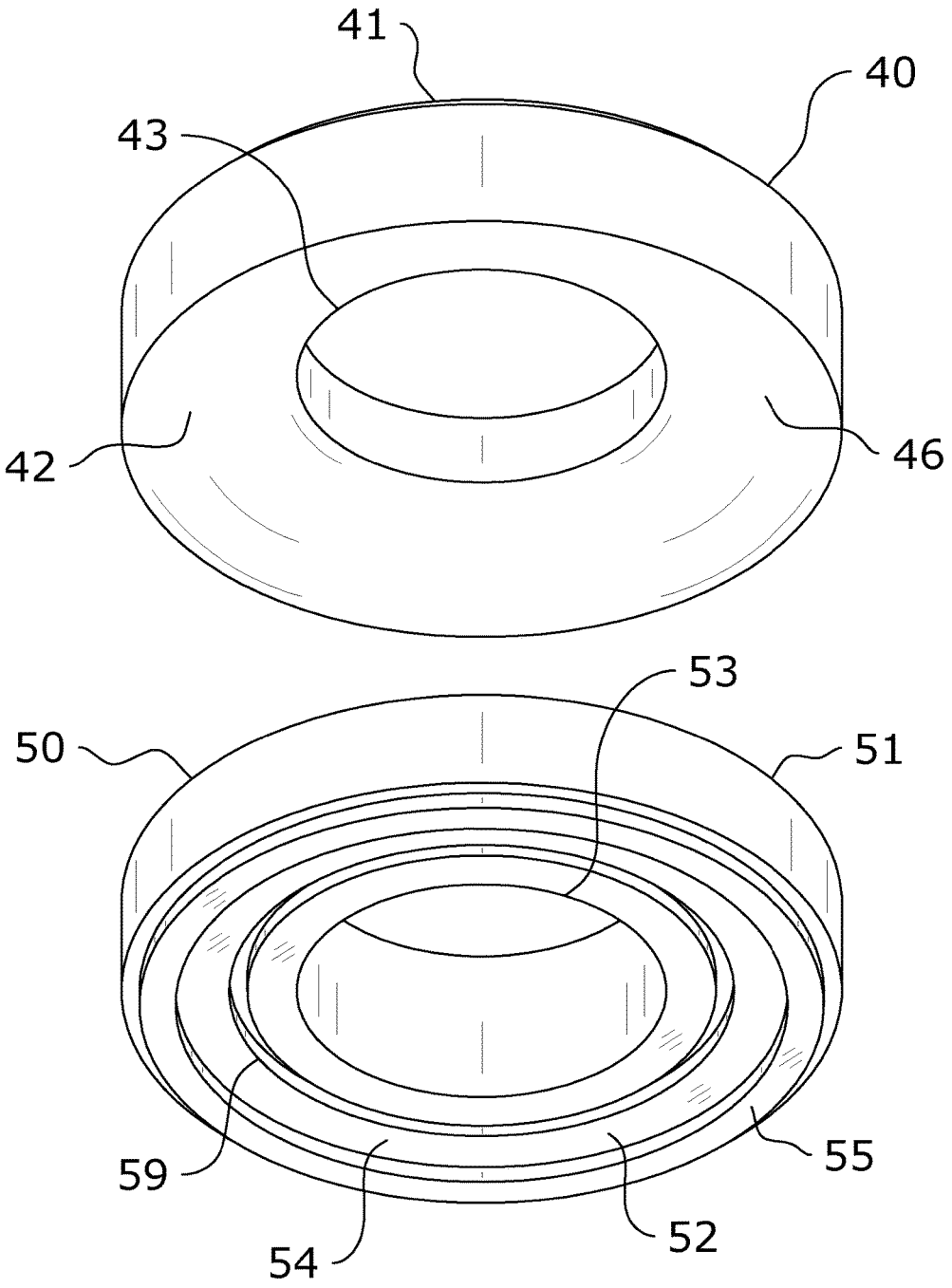
FIG. 13 is a lower perspective view of the alignment members of the second embodiment of the present invention.

As best shown in FIG. 13, the lower end 52 of the second alignment member 50 may include a second recessed portion 54 surrounding the second opening 53 and a second rim 55 extending around its outer circumference which rises outwardly from the second recessed portion 54. The second rim 55 fits within the second receiver groove 38 on the upper end 32 of the second member 30 as shown in FIG. 14 to secure the second alignment member 50 over the second member 30.

Figure 12:
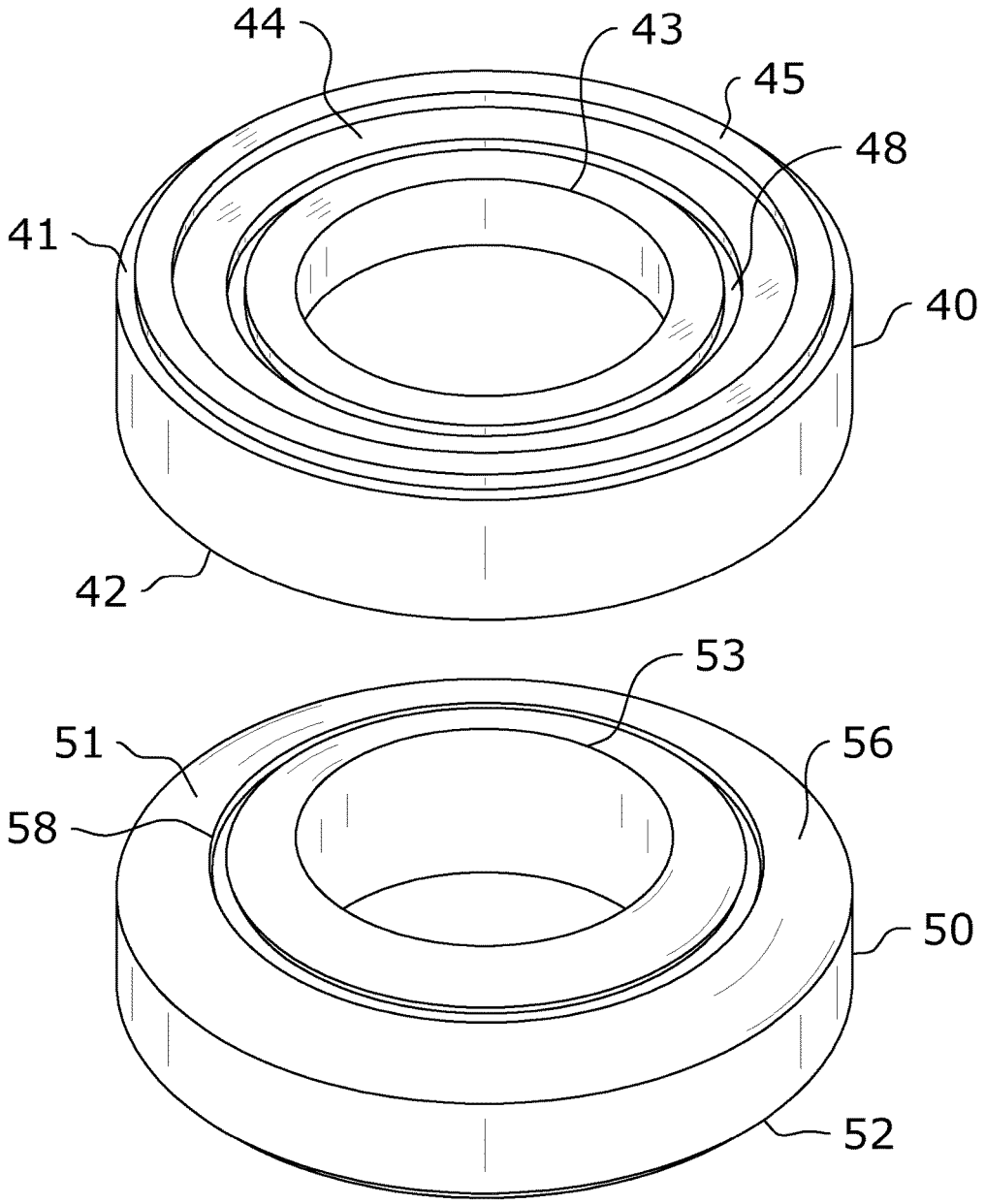
FIG. 12 is an upper perspective view of the alignment members of the second embodiment of the present invention.

The upper end 51 of the second alignment member 50 generally comprises a sloped configuration and thus includes a second sloped portion 56 as best shown in FIG. 12. The second sloped portion 56 will generally slope inwardly from the second opening 53 to the outer edge of the second alignment member 50 as shown in FIG. 12. The first sloped portion 46 and second sloped portion 56 should slope in opposite directions so that they may rock against each other to make adjustments for the polished rod 12. The second sloped portion 56 interacts with the first sloped portion 46 of the first alignment member 40 to allow the alignment members 40, 50 to adjust to accommodate vibrations or other movements of the polished rod 12.

Figure 15:
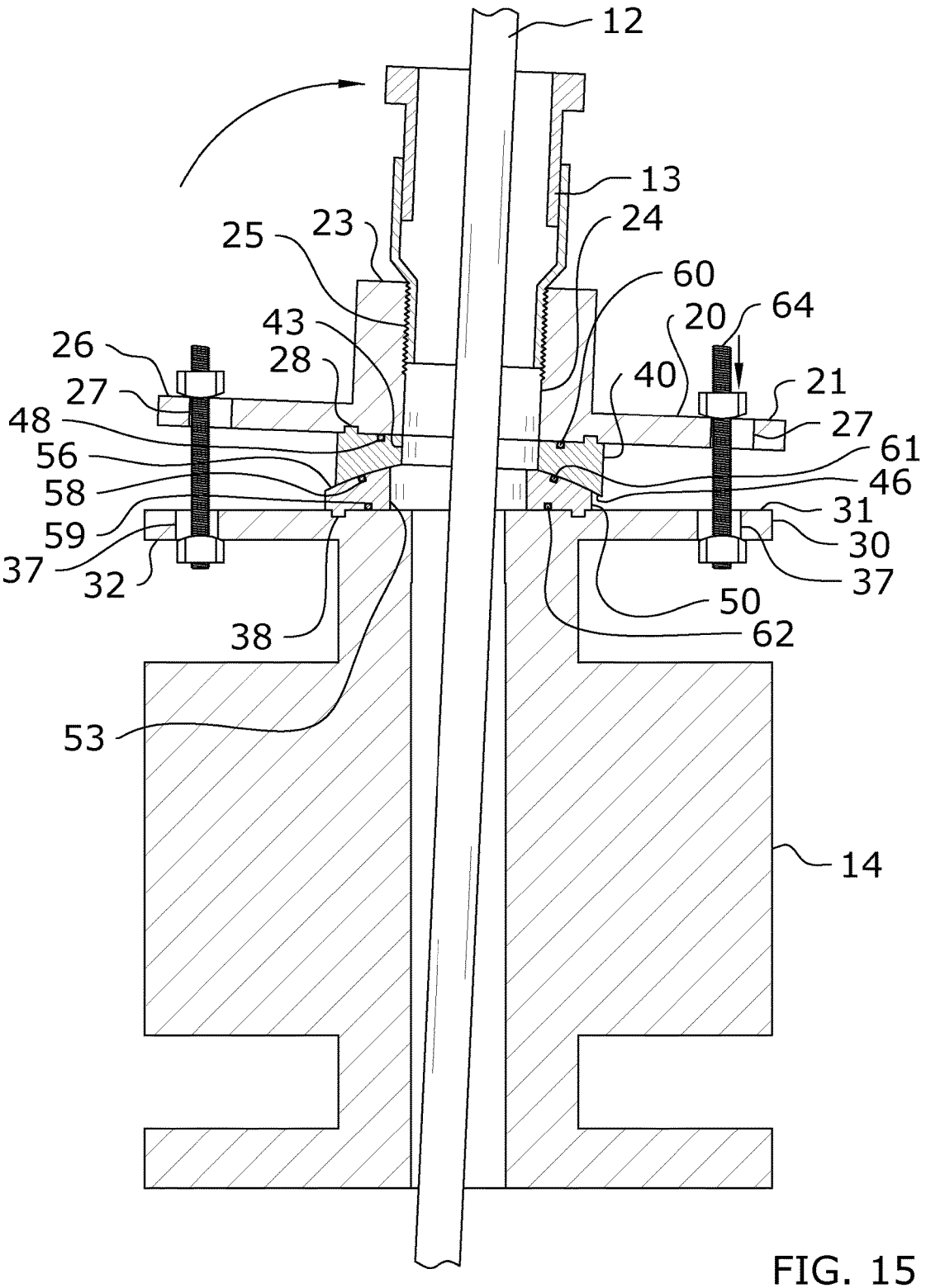
FIG. 15 is a sectional view of the second embodiment of the present invention adjusted for misalignment of the polished rod to the right.
Figure 16:
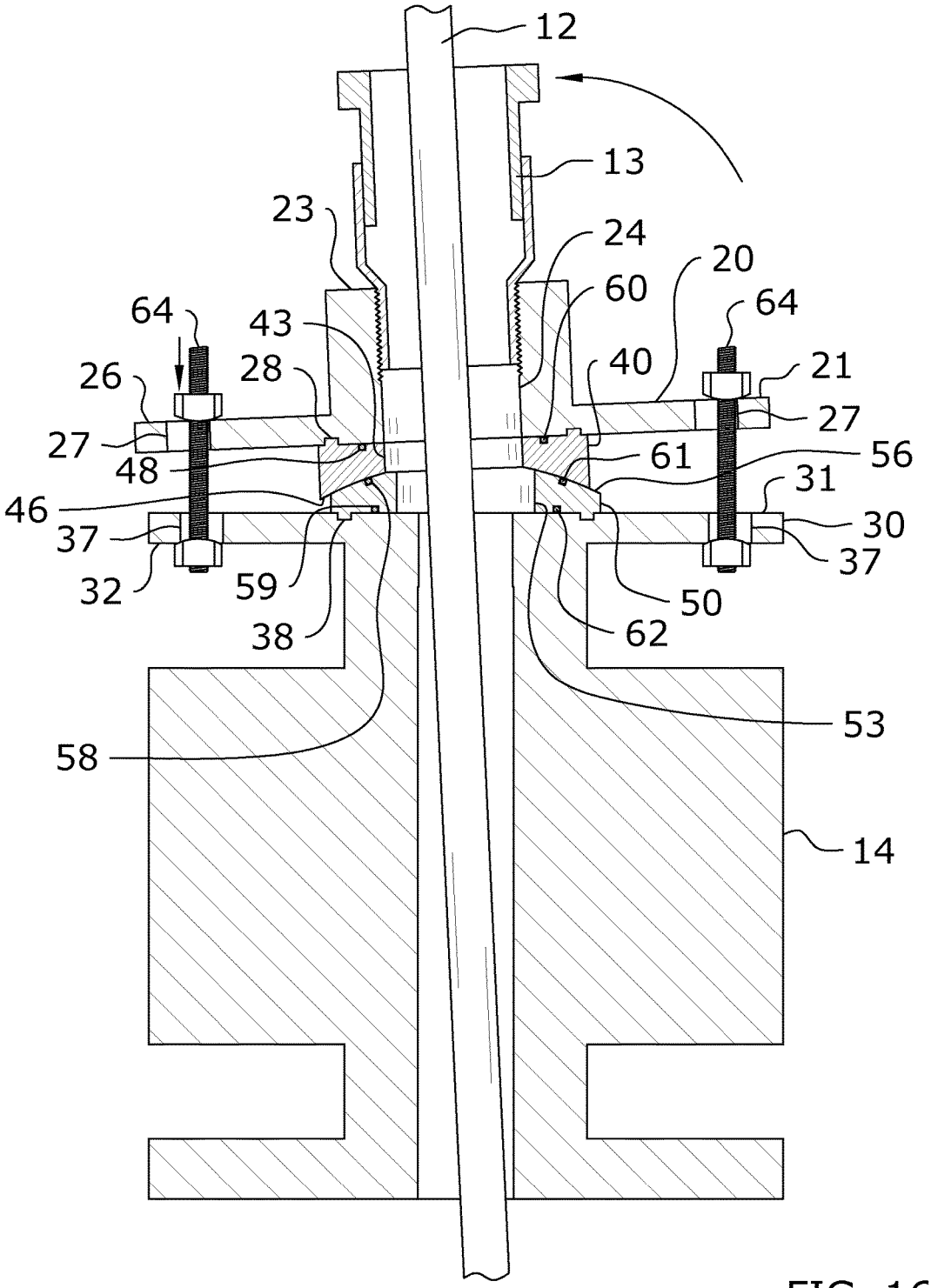
FIG. 16 is a sectional view of the second embodiment of the present invention adjusted for misalignment of the polished rod to the left.

An alternate embodiment of the second alignment member 50, in which O-rings 60, 61, 62 are utilized to perfect seals between the first member 20, the first alignment member 40, the second alignment member 50, and the second member 30 is shown in FIGS. 14-16. In such an embodiment, the second alignment member 50 includes a second upper O-ring groove 58 on its upper end 51 and a lower O-ring groove 59 on its lower end 52 as shown in FIGS. 12-13.

The second upper O-ring groove 58 extends around the second opening 53 of the upper end 51 of the second alignment member 50 as shown in FIG. 12, though other positioning may be utilized. A second O-ring 61 is positioned within the second upper O-ring groove 58 to seal the interconnection between the second alignment member 50 and the first alignment member 40 as shown in FIG. 14.

The lower O-ring groove 59 extends around the second opening 53 of the lower end 52 of the second alignment member 50 as shown in FIG. 13, though other positioning may be utilized. A third O-ring 62 is positioned within the lower O-ring groove 59 to seal the interconnection between the second alignment member 50 and the second member 30.

D. Operation of Preferred Embodiment.

In use, the second member 30 is secured to the oil well, such as to a blowout preventer 14 as shown in the figures. It should be appreciated that a blowout preventer 14 is not necessary for the operation of the present invention, but is merely shown as an exemplary setup which is common in the industry. The second member 30 may be secured to the blowout preventer 14 or other portion of the well via various manners, such as by positioning the second receiver rim 33 into a corresponding opening on the blowout preventer or other structure.

With the second member 30 secured to the blowout preventer 14 (or other oil well structure), the third O-ring 62 is positioned into the lower O-ring groove 59 of the second alignment member 50 if an embodiment using O-rings 60, 61, 62 is being utilized. This step may be skipped if an embodiment is being used without O-rings 60, 61, 62. In either case, the second alignment member 50 may then be secured to the second member 30 by positioning the second rim 55 of the second alignment member 50 into the second receiver groove 38 of the second member 30 such as shown in FIG. 5.

With the second alignment member 50 secured to the second member 30, the first alignment member 40 may be secured to the second alignment member 50. If O-rings 60, 61, 62 are being utilized, the second O-ring 61 is positioned within the second upper O-ring groove 58 of the second alignment member 50. If no O-rings 60, 61, 62 are being utilized, this step may be omitted.

The first alignment member 40 may then be lowered onto the second alignment member 50. The first sloped portion 46 of the first alignment member 40 will receive the second sloped portion 56 of the second alignment member 50 as shown in the figures. The first alignment member 40 and second alignment member 50 will be free to rock with respect to each other for alignment correction when the present invention is in use.

In embodiments using O-rings 60, 61, 62, the first O-ring 60 will be positioned within the first upper O-ring groove 48 of the first alignment member 40. If no O-rings 60, 61, 62 are being utilized, this step may be omitted.

The first member 20 is now ready to be secured to the present invention. The first member 20 is lowered onto the first alignment member 40 such that the first rim 45 of the first alignment member 40 is positioned within the corresponding first receiver groove 28 of the first member 20 as shown in the figures. Bolts 64 may then be inserted through both the first apertures 27 of the first member 20 and the second apertures 37 of the second member 30 to firmly secure the present invention together.

With the present invention assembled, a stuffing box 13 may be installed into the first receiver opening 24 of the first member 20. The polished rod 12 may then be inserted through the present invention to begin pumping operations. As pumping occurs, the polished rod 12 may lose alignment with the stuffing box 13. In this case, the bolts 64 on either side of the present invention may be tightened or loosened to orient the present invention to accommodate for the misalignment, such as shown in FIGS. 6-7 and 15-16. The bolts 64 may be freely adjusted during usage to accommodate for misalignment in any direction.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A polished rod alignment system, comprising:

a first member including a first flange, wherein said first flange includes a plurality of first apertures;

a second member including a second flange, wherein said second flange includes a plurality of second apertures;

a first alignment member between said first member and said second member, wherein said first alignment member includes a first sloped portion;

a second alignment member between said first member and said second member, wherein said second alignment member includes a second sloped portion, wherein said first sloped portion is movably secured against said second sloped portion, wherein the first alignment member and the second alignment member are adapted to freely rock with respect to each other; and a plurality of bolts extending through said first apertures and said second apertures to secure said first member to said second member, wherein said plurality of bolts are adapted to be tightened or loosened such that the first alignment member and the second alignment member rock with respect to each other to adjust an orientation of said first member with respect to said second member.

2. The polished rod alignment system of claim 1, wherein said first member includes a first receiver opening for receiving a polished rod.

3. The polished rod alignment system of claim 2, wherein said first member includes a first receiver rim positioned near said first receiver opening, wherein said first receiver rim is adapted to receive a stuffing box.

4. The polished rod alignment system of claim 3, wherein said second member includes a second receiver opening for receiving said polished rod, wherein said first receiver opening is aligned with said second receiver opening.

5. The polished rod alignment system of claim 4, wherein said second member includes a second receiver rim positioned near said second receiver opening, wherein said second receiver rim is adapted to receive a blowout preventer.

6. The polished rod alignment system of claim 1, wherein said first member includes a first receiver groove and a first opening.

7. The polished rod alignment system of claim 6, wherein said first alignment member includes a first rim, wherein said first rim is positioned within said first receiver groove to secure said first alignment member to said first member.

8. The polished rod alignment system of claim 7, wherein said second member includes a second receiver groove and a second opening.

9. The polished rod alignment system of claim 8, wherein said second alignment member includes a second rim, wherein said second rim is positioned within said second receiver groove to secure said second alignment member to said second member.

10. The polished rod alignment system of claim 1, wherein said first alignment member includes a first upper O-ring groove for receiving a first O-ring.

11. The polished rod alignment system of claim 10, wherein said second alignment member includes a second upper O-ring groove for receiving a second O-ring.

12. The polished rod alignment system of claim 11, wherein said second alignment member includes a lower O-ring groove for receiving a third O-ring.

13. The polished rod alignment system of claim 12, wherein said first O-ring is positioned between said first member and said first alignment member.

14. The polished rod alignment system of claim 13, wherein said second O-ring is positioned between said first alignment member and said second alignment member.

15. The polished rod alignment system of claim 14, wherein said third O-ring is positioned between said second alignment member and said second member.

16. A polished rod alignment system, comprising:

a blowout preventer;

a stuffing box;

a first member, wherein said first member includes a first flange, wherein said first flange includes a plurality of first apertures, wherein said first member includes a first receiver opening, wherein said stuffing box is secured within said first receiver opening;

a second member secured to said blowout preventer, wherein said second member includes a second flange, wherein said second flange includes a plurality of second apertures, wherein said second member includes a second receiver opening;

a first alignment member between said first member and said second member, wherein said first alignment member includes a first sloped portion, wherein said first alignment member includes a first opening, wherein said first alignment member includes a first upper O-ring groove for receiving a first O-ring;

a second alignment member between said first member and said second member, wherein said second alignment member includes a second sloped portion, wherein said first sloped portion is movably secured against said second sloped portion, wherein said second alignment member includes a second opening, wherein said second alignment member includes a second upper O-ring groove for receiving a second O-ring, wherein said second alignment member includes a lower O-ring groove for receiving a third O-ring;

a polished rod extending through said first receiver opening, said second receiver opening, said first opening, and said second opening; and a plurality of bolts extending through said first apertures and said second apertures to secure said first member to said second member, wherein said plurality of bolts are adapted to be tightened or loosened to adjust an orientation of said first member with respect to said second member for realigning with said polished rod, wherein said first O-ring is positioned between said first member and said first alignment member, wherein said second O-ring is positioned between said first alignment member and said second alignment member, and wherein said third O-ring is positioned between said second alignment member and said second member.

17. A polished rod alignment system, comprising:

a first member including a first flange, wherein said first flange includes a plurality of first apertures, wherein said first member includes a first receiver opening for receiving a polished rod, wherein said first member includes a first receiver rim positioned near said first receiver opening, wherein said first receiver rim is adapted to receive a stuffing box;

a second member including a second flange, wherein said second flange includes a plurality of second apertures, wherein said second member includes a second receiver opening for receiving said polished rod, wherein said first receiver opening is aligned with said second receiver opening, wherein said second member includes a second receiver rim positioned near said second receiver opening, wherein said second receiver rim is adapted to receive a blowout preventer;

a first alignment member between said first member and said second member, wherein said first alignment member includes a first sloped portion;

a second alignment member between said first member and said second member, wherein said second alignment member includes a second sloped portion, wherein said first sloped portion is movably secured against said second sloped portion; and a plurality of bolts extending through said first apertures and said second apertures to secure said first member to said second member, wherein said plurality of bolts are adapted to be tightened or loosened to adjust an orientation of said first member with respect to said second member.

* * * * *